US009659726B2

(12) United States Patent
Steinbauer

(10) Patent No.: US 9,659,726 B2
(45) Date of Patent: May 23, 2017

(54) SWITCHING DEVICE WITH IMPROVED TRIPPING ACTION IN THE EVENT OF A SHORT CIRCUIT

(71) Applicant: Siemens Aktiengesellschaft, Munich (DE)

(72) Inventor: Martin Steinbauer, Schmidmühlen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 14/914,521

(22) PCT Filed: Sep. 13, 2013

(86) PCT No.: PCT/EP2013/068981
§ 371 (c)(1),
(2) Date: Feb. 25, 2016

(87) PCT Pub. No.: WO2015/036029
PCT Pub. Date: Mar. 19, 2015

(65) Prior Publication Data
US 2016/0203926 A1 Jul. 14, 2016

(51) Int. Cl.
*H01H 33/02* (2006.01)
*H01H 9/34* (2006.01)
*H01H 71/02* (2006.01)

(52) U.S. Cl.
CPC ..... *H01H 33/02* (2013.01); *H01H 9/346* (2013.01); *H01H 2071/0292* (2013.01)

(58) Field of Classification Search
CPC ..... H01H 2050/025; H01H 51/065; H01H 9/443; H01H 33/664; H01H 33/74;
(Continued)

(56) References Cited

U.S. PATENT DOCUMENTS 8,642,906 B2 * 2/2014 Yeon ..... H01H 50/023 200/430
2002/0149452 A1 * 10/2002 Baujan ..... H01H 73/045 335/132
(Continued)

FOREIGN PATENT DOCUMENTS

CN 1886816 12/2006
DE 4441467 5/1996
(Continued)

OTHER PUBLICATIONS

Office Action dated Nov. 4, 2016 which issued in the corresponding Chinese Patent Application No. 201380077766.3.

*Primary Examiner* — Truc Nguyen
(74) *Attorney, Agent, or Firm* — Cozen O'Connor

(57) ABSTRACT

A switching device having an arc quenching chamber, a fixed contact element and a movable contact element movable in a sliding contact between untripped and tripped positions within the chamber. A plurality of centering structures are arranged on the walls of the arc quenching chamber for centered guiding movement of the movable contact element as it moves from its untripped position to its tripped position. The centering structures may be fabricated unitarily with the chamber walls, as of plastic, and are arranged in parallel and spaced apart relation to one another.

7 Claims, 4 Drawing Sheets

(58) Field of Classification Search
CPC .. H01H 50/38; H01H 1/0015; H01H 33/6661; H01H 50/14; H01H 50/163; H01H 50/546; H01H 9/346; H01H 1/06; H01H 2033/028
See application file for complete search history.

(56) References Cited

U.S. PATENT DOCUMENTS

| | | | | |
|---|---|---|---|---|
| 2005/0135022 | A1 | 6/2005 | Kinzler et al. | |
| 2006/0267714 | A1* | 11/2006 | Fushimi | H01H 77/104 335/172 |
| 2010/0060392 | A1* | 3/2010 | Cho | H01H 50/023 335/124 |
| 2010/0258413 | A1* | 10/2010 | Leischner | H01H 19/64 200/11 R |
| 2014/0062627 | A1* | 3/2014 | Naka | H01H 50/42 335/189 |

FOREIGN PATENT DOCUMENTS

| | | | |
|---|---|---|---|
| DE | 19540972 | A1 | 5/1997 |
| DE | 102007054426 | A1 | 5/2008 |
| EP | 0323404 | | 7/1989 |
| EP | 1073084 | A2 | 1/2001 |

* cited by examiner

SWITCHING DEVICE WITH IMPROVED TRIPPING ACTION IN THE EVENT OF A SHORT CIRCUIT

FIELD OF THE INVENTION

The present invention relates to a switching device with an arc quenching chamber in which is disposed a contact arrangement formed of a fixed contact element and a movable contact element, wherein the movable contact element is guided for movement in a sliding contact.

BACKGROUND OF THE INVENTION

Switching devices, in particular power switches, are used for amongst other things safely switching off power in the event of a short circuit, thus protecting loads and installations. Electrical or mechanical switching devices are also suitable for operationally correct manual switching of loads and for safe disconnection of an installation from the power grid during servicing work or modifications to the installation. Electrical switching units are often operated electromagnetically.

As a consequence, switching units of this type are highly technical electrical switching devices with integrated protection for motors, cables, transformers and generators. They find their application at functional locations with low switching frequency. In addition to short-circuit protection, switching units of this type are also suitable for overload protection.

In the event of a short circuit, an electrical switching unit safely switches off power to an electrical installation. It thus offers fuse protection against overload. Any cable through which the current flows heats up more or less strongly, depending on the ratio of the magnitude of current to the cross-sectional area of the conductive cable, which is known as the current density. The current density must not be too large, since otherwise the cable insulation may become charred, or a fire may break out, as a result of the excessive heat. In order to protect electrical installations against these damaging effects, switching units are used as overcurrent protection devices.

Power switches comprise two independently acting trip mechanisms, connected in series, for overload protection and for short-circuit protection. The protection against short circuits is effected by an electromagnetic trip that operates with almost no time delay. In the event of a short circuit, the electromagnetic trip unlatches a switch lock of the power switch without delay. A switch armature disconnects the contact element before the short-circuit current can reach its maximum value.

Known switching units include a sliding contact unit having a sliding contact and a moving contact element. The moving contact element is itself formed of electrical contacts. Switching units of this type also include first contacts to an electric cable. In a switched-on state, the electrical contacts of the movable contact element contact the fixed contacts of the switching unit. In the event of a short circuit, the electrical contacts of the movable contact element are released from the fixed contacts, so that the flow of current is interrupted. The movable contact element is thus released from the fixed contacts.

Known sliding contacts of switching units frequently comprise two guidance systems, an inner guidance system and an outer guidance system. The outer guidance system is used when the switching procedure, in other words switching on or switching off, is effected by means of a switch lock of the switching unit. This switching of the power state is effected in a controlled manner. The inner guidance system, on the other hand, is used in the event of a short circuit, when the switching procedure is effected by a switching armature, commonly a plunger in combination with a guidance pin, of the switching unit.

Accordingly, when switching off of power as a result of a short circuit, the movable contact element moves quickly along the inner guidance system in front of the sliding contact, strikes impact surfaces in what is known as the lower part of the switching unit, and flies back again along the inner guidance system. In such implementations it flies against the switching armature or the guidance pin of the switching unit.

If heavy short circuits occur, large magnetic forces in turn develop between the movable contact element and the fixed contact elements. These are, in part, the current loop forces between the fixed contact elements and the bridge. There are also large current magnitude forces between the silver contacts. The effect of these two forces is that in the event of a short circuit, the bridge is thrown suddenly against its resulting spring force and strikes against the impact dome in the lower part. Since it is not possible for the impact dome to be positioned in the center of the switching chamber (as this location is required by the guide plate), it has in known constructions been divided and located against the chamber walls. Although the bridge is secured against rotation by a guide pin, its guide play cannot however be adequately limited. If the bridge makes use of the degrees of freedom that it has as a result of its construction, it might only meet the impact dome on one side, and then become wedged in the lower part.

A further problem with these known constructions is that when certain switching activities are carried out at switching devices, in particular at power switches, extreme heating of the switch contact occurs. In particular in the case of changing to the off position after a period of being switched on, the very hot contact bridge can damage the surrounding areas of the housing of the switch chamber, which are usually formed of plastic. This mainly occurs in the off position since, in this case, the thermal losses arising in the bridge cannot flow away into the fixed contact elements, and when in the off position the bridge is in a position that is almost thermally insulated on every side. Since the bridge must be freely movable, it has a certain degree of rotary play in the axial direction of the sliding contact to the switching chamber wall. Under unfavorable conditions, the bridge uses its rotary play and becomes located too close to the plastic wall of the switching chamber; then, as a result of the hot bridge, the plastic swells and surrounds the bridge, as a result of which the power switch is destroyed.

OBJECTS AND SUMMARY OF THE INVENTION

It is accordingly an object of the present invention to provide a switching device that overcomes the above-described problems and disadvantages.

The invention thus provides a switching device with an arc quenching chamber in which is disposed a contact arrangement of a fixed contact element and a movable contact element, wherein the movable contact element is guided in a sliding contact. The movable contact element is guided when tripped by centering structures on the housing walls of the arc quenching chamber.

The problems and disadvantages inherent in prior art switching devices are overcome by the centering structures of the invention, which are injection-molded together with the lower part walls of the switching chamber of the power switch. When the bridge is thrown downwards by the loop and current magnitude forces, it is aligned by the centering structures, and strikes the center of both impact domes. An off-center impact is thus no longer possible, and the bridge cannot become twisted.

A further advantage of the inventive arrangement lies in that through the centering structures the bridge is centrally aligned at the bottom reversal point of the movement. When in its off position, the bridge is thus located relatively accurately in the center of the switching chamber, and it is thereby located sufficiently distant from the two switching chamber walls. In spite of the raised temperature that it can develop after many switching processes or operations, the bridge is at a sufficient distance from the plastic walls to ensure that the bridge does not become burnt into the lower part.

In a particularly advantageous embodiment of the invention, the centering structures are fabricated as a single piece with the housing walls of the arc quenching chamber. This means that the centering structures are formed together with the housing walls of the arc quenching chamber in one process step using an injection molding technique. As a result it is not necessary to manufacture an additional part, but only that the housing walls of the arc quenching chamber be specially shaped.

In accordance with a further embodiment of the invention, the centering structures are formed of plastic. It is therefore possible for the centering structures to be manufactured together with the housing walls of the arc quenching chamber in a single process step in the form of an injection-molding process.

In a particularly advantageous embodiment of the invention, a second set of centering structures is arranged on a second housing wall of the arc quenching chamber located opposite to the first set of centering structures on a first housing wall of the arc quenching chamber, so that the movable contact element is positioned between two sets of centering structures. This arrangement also contributes to uniform guidance of the movable contact element.

The centering structures can additionally be arranged to the side next to the sliding contact, so that when tripped the movable contact element is reliably guided.

The switching device of the invention is preferably a power switch.

Thus, in accord with a particularly preferred implementation of the present invention, the switching device comprises an arc quenching chamber in which a sliding contact is arranged, and in which a movable contact element is guided. Disposed to the side, next to the movable contact element on both the right and the left, are arc quenching baffle packages comprised of arc quenching baffles arranged in parallel over one another.

Located on a housing wall of the arc quenching chamber, in the region of the movable contact element, are the centering structures of the invention. These centering structures are preferably fabricated as a single piece with the housing wall of the arc quenching chamber; thus, the centering structures are not formed as an additional part on the housing wall, but are injection-molded together with the housing wall in one process step. The centering structures are accordingly preferably also formed of plastic.

The centering structures of the invention are preferably arranged parallel and in spaced apart relation to one another on the housing wall of the arc quenching chamber. A second set of centering structures is preferably also arranged on a second housing wall of the arc quenching chamber located opposite to a first set of centering structures on a first housing wall of the arc quenching chamber, so that the movable contact element is positioned between two sets of centering structures.

The centering structures of the invention are preferably arranged next to the sliding contact, i.e. to the right and to the left of the sliding contact.

A prior art switching device of the type herein taught, in particular when used as a power switch with high switching capacity, is characterized in that less room is available for bridge guidance in order to always align the bridge in the center of the chamber. Due to the increased forces that throw the bridge in the event of a short circuit, and as a result of a potentially non-central position of the bridge, the bridge can become jammed in the lower part, as a result of which the device can no longer be switched on. Through the provision of centering structures in accordance with the present invention, however, the bridge always meets the impact dome symmetrically, and jamming is avoided. A further advantage provided by the present invention is that by virtue of the centering structures, the bridge is aligned centrally during the course of its movement, and thereby always maintains adequate distance from the chamber walls when in the off position. Melting of structures within the switching chamber is thus prevented.

Further advantages and embodiments of the invention are explained below with reference to exemplary embodiments and to the drawings.

DETAILED DESCRIPTION OF THE PREFERRED EMBODIMENTS

Figure 1:
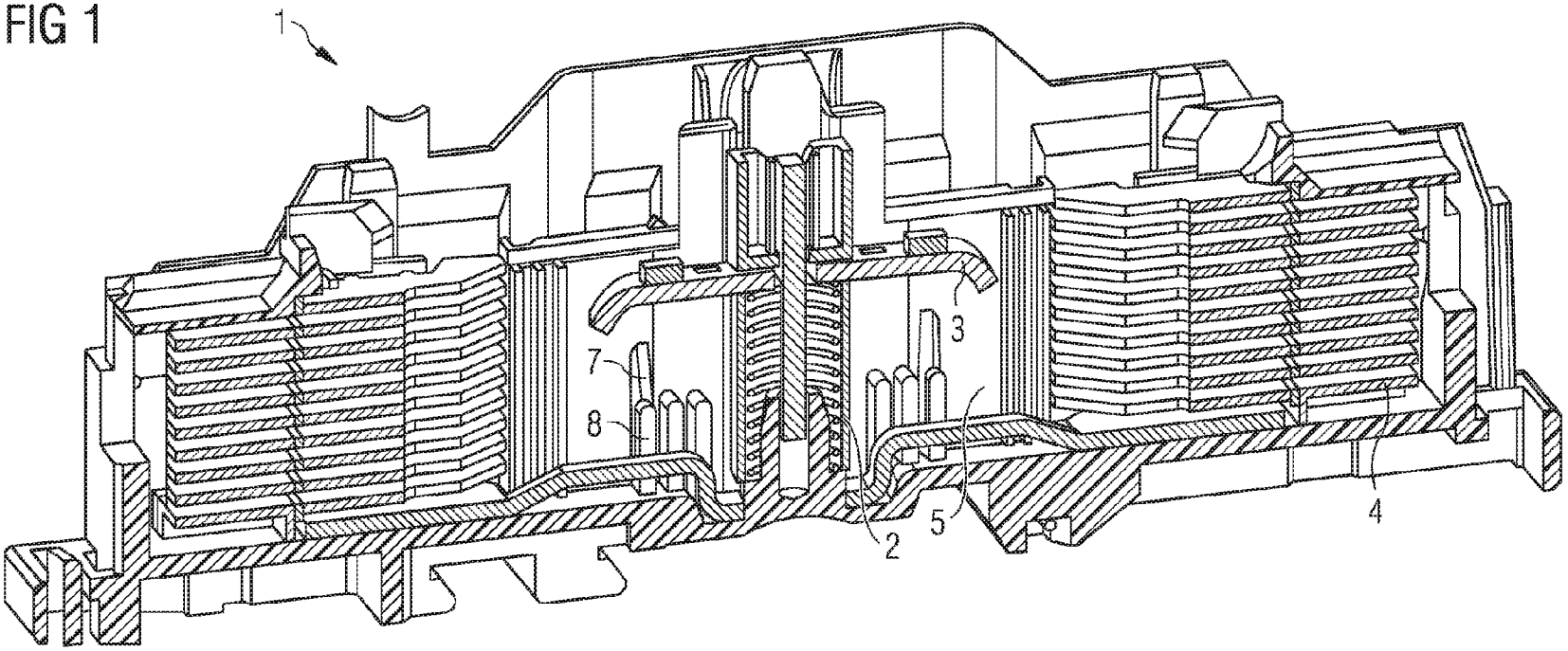
FIG. 1 is a cross-sectional view of a switching device in accordance with the invention including an arc quenching chamber and a sliding contact in which a movable contact element is guided.

FIG. 1 shows a cross-sectional view of a switching device, in particular of a power switch with an arc quenching chamber 1, constructed in accordance with the invention and in which a sliding contact 2 is arranged and a movable contact element 3 is guided for movement. Arranged on both the left and right sides of, and next to, the movable contact element 3 are arc quenching baffle packages 4 each formed of plural arc quenching baffles disposed in parallel relation above one another. Centering structures 7 of the invention are provided on a housing wall 5 of arc quenching chamber 1 in the region of movable contact element 3.

The centering structures 7 are preferably fabricated as a single piece with housing wall 5 of the arc quenching chamber, which is to say that the centering structures 7 are not formed as an additional part on the housing wall 5 but, rather, are injection-molded together with the housing wall 5 in one process step. The centering structures 7 are accordingly preferably formed of plastic. The centering structures 7 are moreover preferably arranged on housing wall 5 of the arc quenching chamber 1 parallel to one another and at a distance or spacing from one another.

In preferred embodiments of the invention, a second set of centering structures 7 is additionally arranged on a second housing wall of the arc quenching chamber 1 located opposite to the first set of centering structures 7, so that the movable contact element 3 is positioned between the two sets of centering structures.

The centering structures 7 are preferably arranged to the side next to the sliding contact 2, i.e., to the right and to the left of the sliding contact 2.

Figure 2:
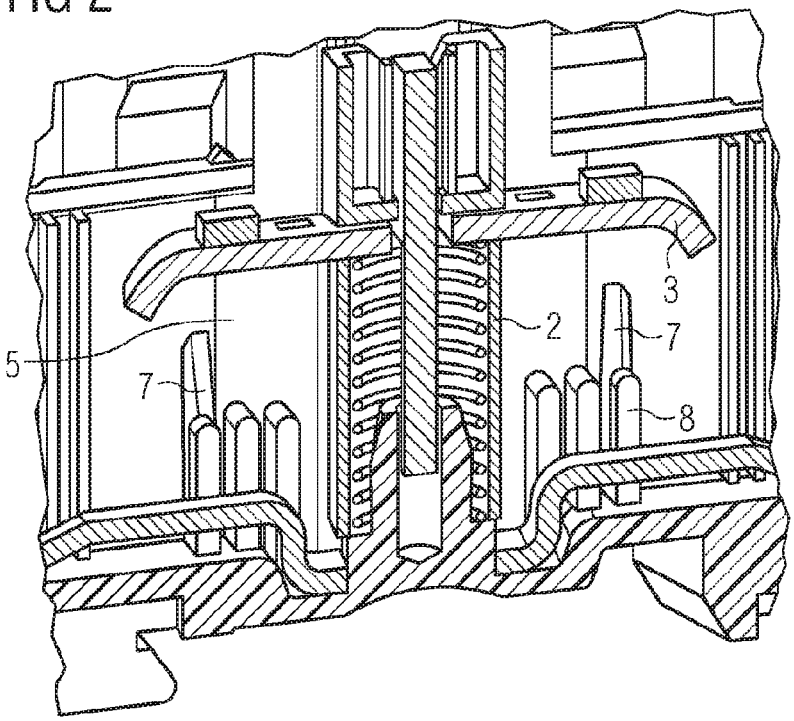
FIG. 2 is an enlarged sectional view of a section of the switching device of FIG. 1 depicting a sliding contact, a movable contact element and centering structures in accordance with the invention.

Depicted in FIG. 2 is the region around sliding contact 2, i.e., the region to the left and to the right of sliding contact 2. The positioning of the centering structures 7, which are arranged to the left and to the right of sliding contact 2, can be seen in FIG. 2.

Figure 3:
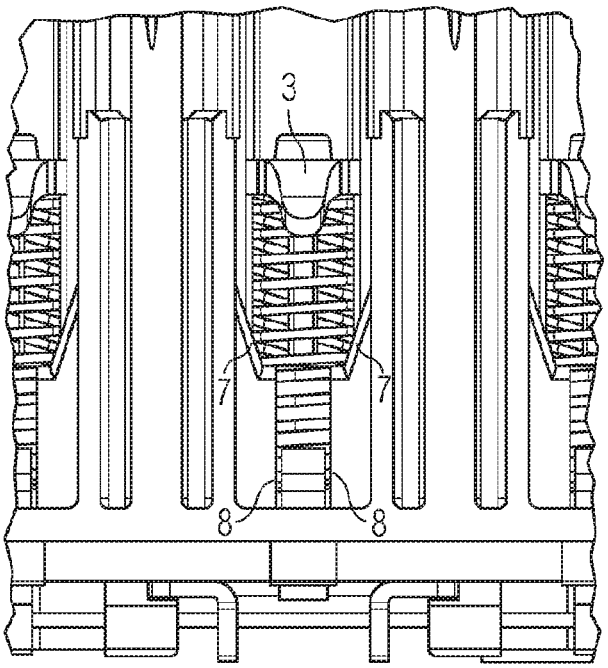
FIG. 3 is an enlarged cross-sectional side view of the centering structures and movable contact element shown in FIG. 2.

FIG. 3 shows the two regions of the centering structures 7 as a cross-section from the side. When tripped, the movable contact element 3 is first guidedly accepted by the centering structures 7 and then strikes against the impact dome 8.

Figure 4:
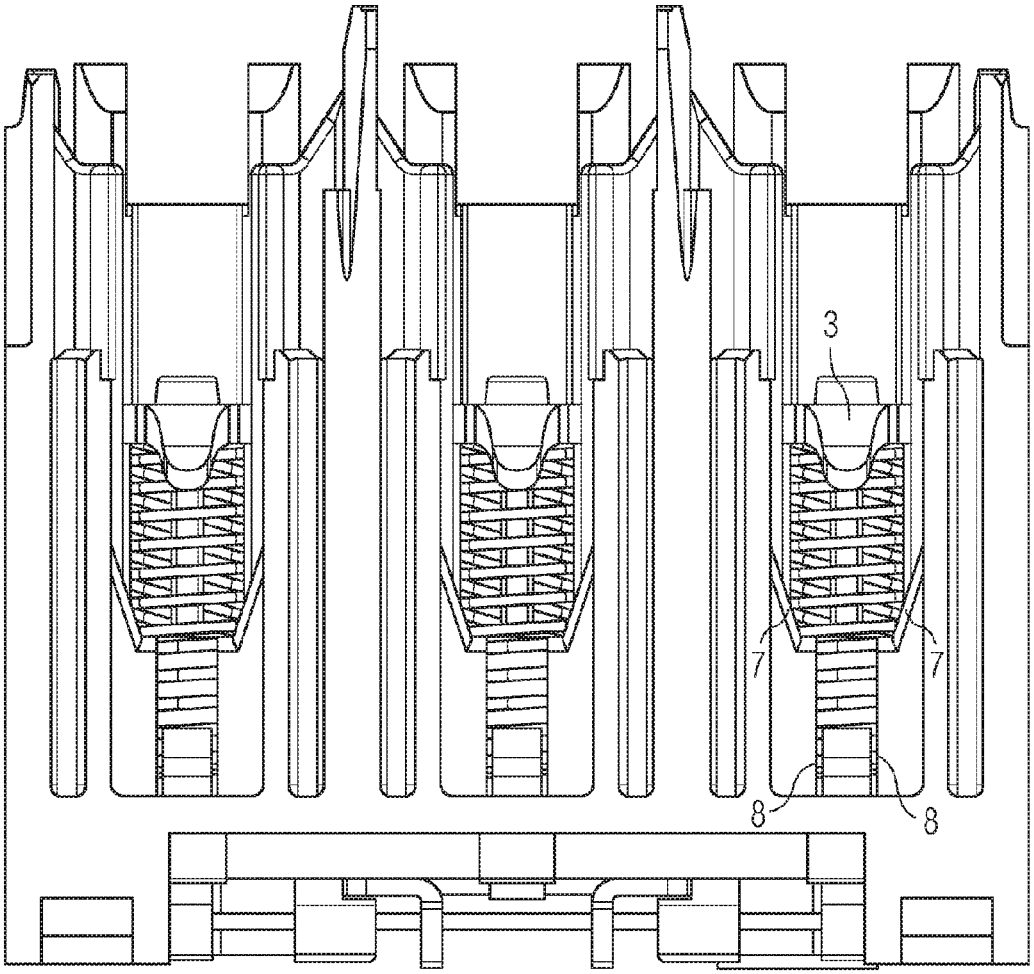
FIG. 4 is a cross-sectional view of the centering structures of the invention with the movable contact element depicted in the on or untripped position.
Figure 5:
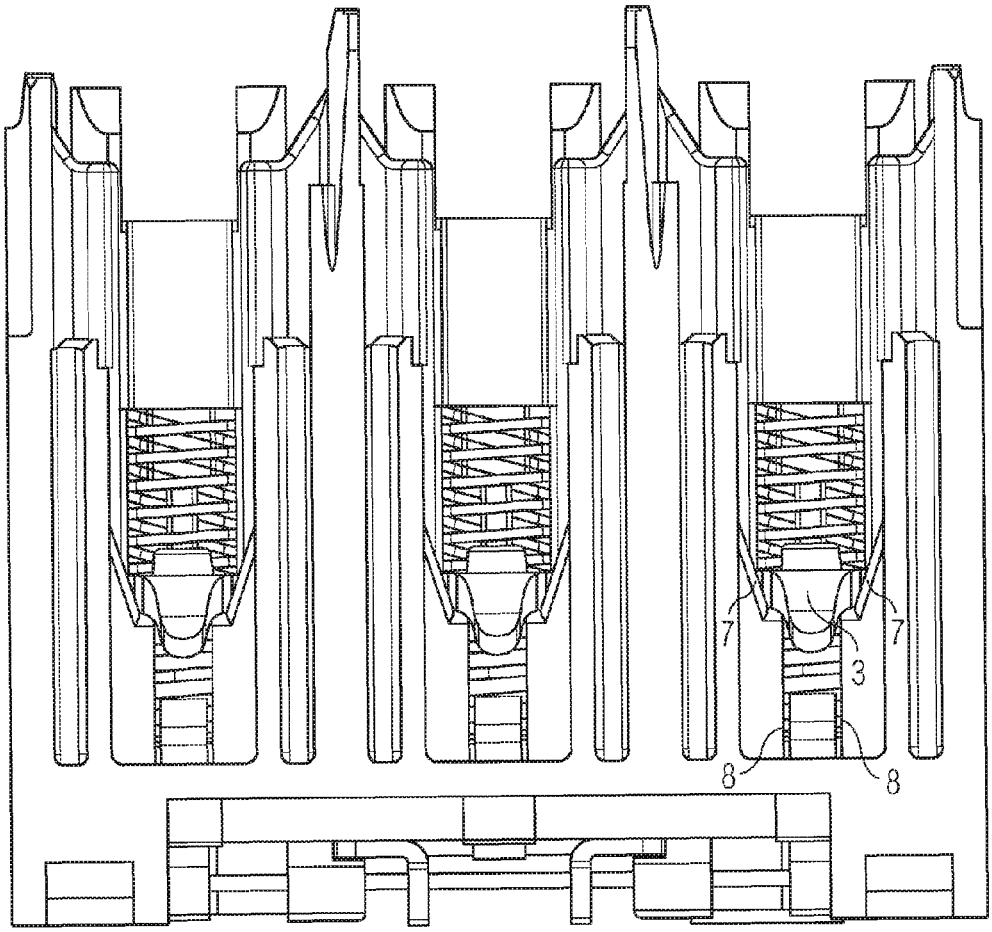
FIG. 5 is a cross-sectional view similar to FIG. 4 of the centering structures of the invention with the movable contact element depicted in the tripped state during a short circuit.

The position of the movable contact element when in the switched-on (i.e. untripped) state can be seen in FIG. 4. FIG. 5 depicts the position of movable contact element 3 in the tripped state during a short circuit event.

As a result of the centering structures of the invention, the bridge always meets the impact dome symmetrically, and jamming is avoided. Moreover, the centering structures assure that the bridge is centrally aligned during its movement and, when in its off position, the bridge is maintained at an adequate distance from the chamber walls, thus preventing melting of structures within the switching chamber.

The invention claimed is:

1. A switching device, comprising:

an arc quenching chamber having housing walls;

a sliding contact disposed entirely within the arc quenching chamber;

a movable contact element arranged in the sliding contact for guiding movement of the movable contact element from an untripped position to a tripped position; and a plurality of centering structures arranged on the housing walls of the arc quenching chamber for guiding movement of the movable contact element from the untripped position to the tripped position.

2. The switching device of claim 1, wherein the centering structures are unitarily fabricated as a single piece with the housing walls of the arc quenching chamber.

3. The switching device of claim 1, wherein the centering structures are formed of plastic.

4. The switching device of claim 1, wherein the plural centering structures are arranged in parallel and spaced apart relation to one another.

5. The switching device of claim 1, wherein the plural centering structures comprise a first set of centering structures and a second set of centering structures, and wherein the first set of centering structures is arranged on a first housing wall of the arc quenching chamber and the second set of centering structures is arranged on a second housing wall of the arc quenching chamber that is opposite the first housing wall so that the movable contact element is positioned between the first and second sets of centering structures.

6. The switching device of claim 1, wherein the centering structures are arranged on sides of and adjacent to the sliding contact.

7. The switching device of claim 1, wherein the switching device comprises a power switch.

* * * * *